United States Patent [19]

Fontaine

[11] Patent Number: 4,862,825

[45] Date of Patent: Sep. 5, 1989

[54] METHOD AND APPARATUS FOR STRIPPING METAL SHEET COATED WITH MOLTEN MATERIAL

[75] Inventor: Paul P. Fontaine, Langenfeld, Fed. Rep. of Germany

[73] Assignee: Unitas S.A., Allee Marconi, Luxemburg, Fed. Rep. of Germany

[21] Appl. No.: 96,554

[22] Filed: Sep. 14, 1987

[30] Foreign Application Priority Data

Sep. 19, 1986 [DE] Fed. Rep. of Germany ..... 3631893

[51] Int. Cl.[4] ..... B05C 11/06

[52] U.S. Cl. ..... 118/63; 118/428; 427/349

[58] Field of Search ..... 118/63, 428; 427/349

[56] References Cited

U.S. PATENT DOCUMENTS 4,296,145 10/1981 Higuchi et al. ..... 427/349 X
4,330,574 5/1982 Pierson et al. ..... 427/349 X
4,612,215 9/1986 Hennechart et al. ..... 118/63 X

*Primary Examiner*—Shrive Beck
*Assistant Examiner*—Alain Bashore
*Attorney, Agent, or Firm*—Merchant, Gould, Smith, Edell, Welter & Schmidt

[57] ABSTRACT

For stripping sheet metal coated in a galvanizing or vitreous-coating installation directly after the coated sheet has left a bath of molten coating material, both sides of the sheet are blasted with a thin curtain of gas. For this purpose a gas is used which is significantly heavier than air and is recirculated, the gas being for example sulfur hexafluoride or a mixture containing this gas.

14 Claims, 1 Drawing Sheet

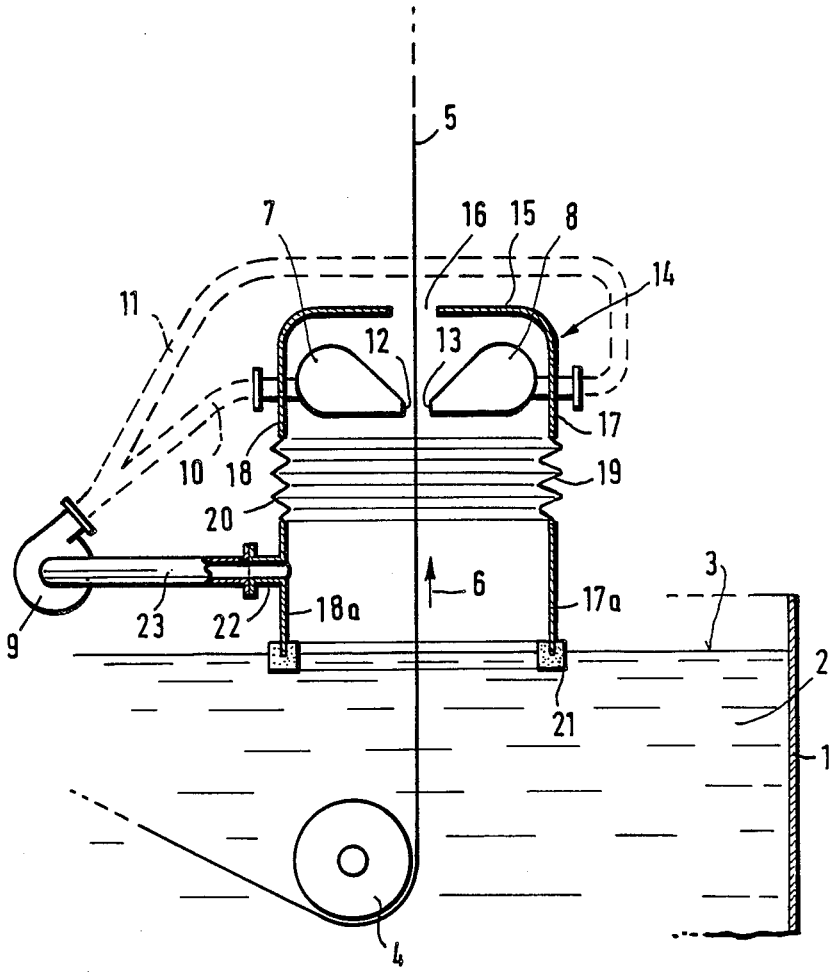
5
7
16
15
8
14
11
12
13
17
10
18
19
20
6
3
9
23
22
18a
17a
2
21
1
4

METHOD AND APPARATUS FOR STRIPPING METAL SHEET COATED WITH MOLTEN MATERIAL

BACKGROUND OF THE INVENTION

The invention relates to a method of stripping metal sheets coated with molten material and in particular to stripping sheet or sheet material coated in a galvanising or vitreous-coating installation directly after the coated sheet has left a bath of molten coating material, both sides of the strip-like or web-like sheet being blasted with a thin curtain of gas. In addition the invention relates to apparatus for carrying out this method with two opposed gas nozzles which are arranged near and above the bath from which the sheet is drawn, and which form a thin curtain of gas for blasting both sides of the strip-shaped sheet or sheet-like material passing between them.

It is known, in the case of sheet and in particular strip-shaped sheet material which has been coated with molten coating material in a galvanising or vitreous-coating installation, to blast the surfaces of the sheet with a thin curtain of gas in order to strip off surplus coating material and prevent lumps or ribs of the coating material forming on the surfaces and thereby not only giving rise to unattractive surfaces, but also making the coating unnecessarily thick at different regions, representing an unnecessarily high consumption of coating material.

It is known to blast the surfaces of the coated sheet with air. However this leads to oxidation or other actions on the coating material, which again can result in flaws in the coated surfaces. Accordingly there has been a move towards using an inert gas such as nitrogen for blasting the surfaces of the coated sheet. It is true that this does satisfactorily eliminate the oxidation problem, but the gas consumption is relatively high, leading to undesirable increases in cost.

SUMMARY OF THE INVENTION

The object of the invention is to be able to carry out the coating of sheet metal coated in a galvanising or vitreous-coating installation and in particular of a sheet material of strip-like form passing continuously through such an installation, on the one hand without unwanted oxidation problems and on the other hand as economically as possible.

To solve this problem the method of the kind outlined in the introduction is arranged so that the sheet or strip-like sheet material is blasted with an inert gas which is significantly heavier than air and is recirculated. In particular according to the invention the sheet metal is blasted with sulfur hexafluoride or a mixture containing it.

A gas or gas mixture which is significantly heavier or many times heavier than air falls downwards more or less vertically under its own weight. Accordingly it can be relatively easily recovered and fed back for renewed use. The inert gas such as nitrogen which have been used hitherto for blasting coated sheet metal surface are only relatively slightly heavier than air and on the basis of their own density they do not separate, or separate only insufficiently, from air. Accordingly recovery of such gases is poor and also only possible to a limited extent. Also such gases cannot protect the surface of the molten coating material present in the bath of a galvanising or vitreous-coating installation sufficiently or completely enough against the action of atmospheric oxygen.

A gas such as sulfur hexafluoride is about five times heavier than nitrogen and even more markedly heavier than air so that is separates itself thoroughly from air on the basis of its own density alone and accordingly it can be specifically sucked away and fed back for renewed use. In the border zone between this gas and the air there are no zones in which a mixture between air and this gas is present and oxidation is possible. Added to this is the fact that the relatively heavy sulfur hexafluoride does not rise upwards and accordingly for its recovery it is only necessary to ensure that it can fall into a defined zone or a defined space from where it can be conducted away and thereby recovered for renewed use.

A further object of the invention is to provide apparatus for stripping surplus coating material from the surface of sheet metal in which the two blast nozzles arranged opposite one another over a bath of molten coating material are arranged in a box-like sleeve of which the side and end walls extend down at least to the level of the surface of the melt and which has in its upper face an opening for the continuously emerging sheet material. This box-shaped sleeve which can be regarded as a kind of housing and which has its side and end walls reaching down to the surface of the melt, forms with the melt a chamber from which the gas emerging from the blast nozzles cannot escape in an uncontrolled manner as long as care is taken that the gas is drawn off in sufficient quantity from the sleeve for its recovery. The gas which is blown in does not escape through the opening provided in the upper face of the sleeve for the emerging sheet material because it is heavier than oxygen and accordingly has the tendency to sink downwards. Only if the gas is not conducted away from the sleeve can it eventually emerge from the top opening.

So that the heavy gas blown into the sleeve can be conducted away in sufficient quantities, i.e. at least at the rate at which it is fed in, according to a further feature of the invention a pipe fitting is provided below the blast nozzles arranged in the sleeve, for carrying away the gases emerging from the blast nozzles. A suction pipe with a suction fan can be connected to this fitting.

So that the sleeve always co-operates with the melt in the bath in the right manner, according to a further feature of the invention the sleeve is provided at its lower rim with buoyancy bodies or floats which make contact with the melt present in the bath and, so-to-speak, float on the melt. Accordingly variations in the level of the surface of the melt are automatically compensated.

In order to allow such compensation in a particularly favourable manner it is arranged according to yet another feature of the invention, that the sleeve is provided in its side and end walls with an expanding portion which can be in the form of bellows. In this way the lower part of the sleeve can float on the melt, while the upper part of the sleeve is secured to a fixed point. The position of the sleeve in the apparatus can thereby be accurately fixed without adversely affecting the matching to the height of the surface of the melt.

BRIEF DESCRIPTION OF THE DRAWING

In the drawing there is illustrated diagrammatically in side view an embodiment of the apparatus according to the invention for stripping off surplus coating material from the surface of a strip of sheet metal passing through this apparatus.

DESCRIPTION OF THE PREFERRED EMBODIMENT(S)

In a vat 1 of a galvanising installation, not illustrated further, there is a zinc melt 2 of which the surface 3 is of variable height within certain limits according to the consumption of zinc and the quantity replenished.

At least one direction-changing roller 4 is mounted immersed in the melt and the web of material 5 is conducted over it, this web being of sheet material and passing through the apparatus in the direction of an arrow 6 in a manner not explained further. Further guide elements for the web of material 5 are omitted in order to keep the drawing simple.

Above the vat 1 there are two mutually opposed blast nozzles 7 and 8 of a known kind, to which a blower 9 is connected through pipes 10 and 11 in order to feed under pressure to the nozzles 7 and 8 a gas which is heavier than air, for example sulfur hexafluoride. This gas is blasted from mutually facing slot-shaped nozzle openings 12 and 13 so that it forms a substantially horizontal curtain through which the web 5 passes. By means of this blast any surplus coating material picked up from the melt 2 in the vat 1 is stripped away from the surface of the web 5.

The nozzles 7 and 8 are mounted in a box-shaped sleeve 14 of which the top wall 15 has a relatively wide slot-shaped opening 16 through which the web 5 can emerge.

The side walls 17 and 18, like the end walls which are not illustrated in detail in the drawing, have bellows-shaped expansion or extension portions 19 and 20 which make it possible for the lower portions 17*a* and 18*a* of the walls to move vertically relative to the upper part of the sleeve 14 or vice versa. Extending around the lower rim of the lower portions 17*a* and 18*a* of the side walls there is a float 21 which supports the side wall portions 17*a* and 18*a* on the melt 2 and is submerged slightly below the level of the surface 3 so that it forms a peripheral seal which prevents any of the gas blown into the sleeve 14 through the nozzles 7 and 8 escaping below the lower edge of the sleeve.

In the lower portion 18*a* of the side wall 18 there is a connecting spigot 22 connected to a pipe 23 leading to the suction side of the blower 9. By this means the blower 9 sucks away from the lower part of the sleeve 14 the gas which has been used for feeding the nozzles 7 and 8. As practically none of the gas is lost, in practice relatively little additional gas needs to be added for supplying the nozzles 7 and 8.

The gas or gas mixture which is resting on the surface of the metal melt and is heavier than air protects the melt against corrosion. Moreover, it is thermally insulating and offers some sound protection.

The invention is also suitable for other uses in which a gaseous insulating layer is desirable or advantageous. For example a siphon, i.e. a U-shaped or similarily formed tube bend can be filled at its lower portion with sulfur hexafluoride or a mixture containing it, which is heavier than air in order to keep apart two gases, a liquid and a gas or even a metal melt from the surrounding atmosphere.

Carbon dioxide is for example suitable as a component for mixing with sulfur hexafluoride.

I claim:

1. Apparatus for stripping surplus coating material from the surface of a web of sheet metal which has passed through a bath of molten coating material in a coating installation, said apparatus comprising two mutually opposed blast nozzles arranged close above said bath, and forming a thin curtain of gas for blasting both sides of said web passing between them, wherein said blast nozzles are arranged in a box-shaped sleeve having a top wall and side and end walls and wherein said side and end walls extend at least down to a lower rim having buoyancy bodies, said lower rim maintaining contact with said molten coating material in said bath whereby variations in the level of the surface of said molten coating material in said bath are automatically compensated, and wherein an opening for the emergence of said web of sheet metal is provided in said box-shaped sleeve.

2. The apparatus set forth in claim 1 wherein said sleeve further comprises a pipe connection below said blast nozzles, said pipe connection being adapted for conducting away the gas emerging from said nozzles.

3. The apparatus set forth in claim 1, wherein said side and end walls of said sleeve contain an expansion portion.

4. The apparatus set forth in claim 3, wherein said expansion portion is in the form of bellows.

5. Apparatus for stripping surplus coating material from the surface of a web of sheet metal which has passed through a bath of molten coating material in a coating installation, said apparatus comprising:

(a) two mutually opposed blast nozzles arranged close above said bath, and forming a thin curtain of gas for blasting both sides of said web passing between them, wherein said blast nozzles are arranged in a box-shaped sleeve having a top wall and side and end walls and wherein said side and end walls extend at least down to the level of the surface of said molten coating material in said bath and said sleeve has therein an opening for the emergence of said web of sheet metal, whereby when said gas is significantly heavier than air, then said gas tends to form an environment of said gas within said sleeve; and (b) means, connected to said sleeve, for providing buoyancy to said sleeve such that said sleeve cooperates with the surface of said bath, whereby said sleeve maintains contact with said bath despite variations in the level of the surface of said molten coating material in said bath.

6. The apparatus set forth in claim 5 wherein said sleeve further comprises a pipe connecton below said blast nozzles, said pipe connection being adapted for conducting away the gas emerging from said nozzles and means for recirculating said gas back to said blast nozzles.

7. The apparatus set forth in claim 6, wherein said sleeve has a lower ring and said bouyancy means are connected to said rim.

8. The apparatus set forth in claim 2, wherein said side and end walls of said sleeve contain an expansion portion.

9. The apparatus set forth in claim 7, wherein said side end walls of said sleeve contain an expansion portion.

10. The apparatus set forth in claim 8, wherein said expansion portion is in the form of bellows.

11. The apparatus set forth in claim 9, wherein said expansion portion is in the form of bellows.

12. The apparatus of claim 6, wherein said gas comprises predominantly sulfur hexafluoride.

13. The apparatus set forth in claim 11 wherein said opening for the emergence of said web of sheet metal is located in said top wall of said sleeve.

14. The apparatus set forth in claim 13 wherein the buoyancy means comprises buoyancy bodies.

* * * * *